US007462082B2

(12) United States Patent
Kishibata et al.

(10) Patent No.: US 7,462,082 B2
(45) Date of Patent: Dec. 9, 2008

(54) CONTROL DEVICE FOR POWER TRIM UNIT FOR OUTBOARD ENGINE

(75) Inventors: Kazuyoshi Kishibata, Numazu (JP); Tomohiro Kinoshita, Numazu (JP)

(73) Assignee: Kokusan Denki Co., Ltd., Shizuoka (JP)

( * ) Notice: Subject to any disclaimer, the term of this patent is extended or adjusted under 35 U.S.C. 154(b) by 0 days.

(21) Appl. No.: 12/107,200

(22) Filed: Apr. 22, 2008

(65) Prior Publication Data

US 2008/0261466 A1 Oct. 23, 2008

(30) Foreign Application Priority Data

Apr. 23, 2007 (JP) ..... 2007-112964

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS 4,318,699 A * 3/1982 Wenstadt et al. ..... 440/1
4,778,414 A * 10/1988 Taguchi ..... 440/1
4,813,896 A * 3/1989 Koike et al. ..... 440/61 R
5,142,473 A * 8/1992 Davis ..... 701/21
5,263,432 A * 11/1993 Davis ..... 114/286
6,048,234 A * 4/2000 Uematsu et al. ..... 440/1

FOREIGN PATENT DOCUMENTS

JP 61-105296 A 5/1986

* cited by examiner

*Primary Examiner*—Stephen Avila
(74) *Attorney, Agent, or Firm*—Pearne & Gordon LLP

(57) ABSTRACT

A control device for a power trim unit for an outboard engine includes: a circuit that supplies a driving current to a power trim motor of the outboard engine from a DC power supply through an overcurrent protection switch and an H bridge circuit comprised of semiconductor switches; a trim angle control portion that performs control to cause a trim angle to reach a target value by performing PWM control of the driving current supplied from the DC power supply through the H bridge circuit to the power trim motor according to a deviation between the target value of the trim angle of the outboard engine and a trim angle detected by a trim angle sensor; and an overcurrent protection portion that turns off the overcurrent protection switch when overcurrent flows through the H bridge circuit.

5 Claims, 5 Drawing Sheets

CONTROL DEVICE FOR POWER TRIM UNIT FOR OUTBOARD ENGINE

TECHNICAL FIELD OF THE INVENTION

The present invention relates to a control device for controlling a power trim unit for an outboard engine.

PRIOR ART OF THE INVENTION

Outboard engines have been widely used as propulsion devices of boats such as motor boats. In a boat using an outboard engine as a propulsion device, a propulsion force is changed according to an orientation of a propeller of the outboard engine. Thus, for efficiently obtaining the propulsion force, a tilt angle (trim angle) of the outboard engine with respect to a boat body needs to be adjusted to an optimum angle. Thus, in a relatively large outboard engine, as disclosed in Japanese Patent Application Laid-Open Publication No. 61-105296, a PTT (Power-trim and tilt) device that uses a hydraulic mechanism or the like as a power source and changes a tilt of an outboard engine with respect to a boat body is provided between left and right brackets that mount the outboard engine to a stern (transom) of the boat body.

The PTT device includes, for example, a hydraulic mechanism that changes a tilt of an outboard engine with respect to a boat body, and a power trim motor that drives a hydraulic pump for supplying pressure oil to the hydraulic mechanism, and is comprised so as to displace the outboard engine in a trim up direction (a direction of increasing a trim angle) by rotating the power trim motor in one direction, and displace the outboard engine in a trim down direction (a direction of decreasing the trim angle) by rotating the power trim motor in the other direction. In the control device disclosed in Japanese Patent Application Laid-Open Publication No. 61-105296, tilt angle detection means for detecting a tilt angle of an outboard engine main body is provided, and the power trim motor is controlled so as to maintain an optimum tilt angle of the outboard engine detected by the detection means.

The control device disclosed in Japanese Patent Application Laid-Open Publication No. 61-105296 includes two relays: a trim up relay excited when the power trim motor is rotated in the direction of increasing the trim angle (trim up direction), and a trim down relay excited when the power trim motor is rotated in the direction of decreasing the trim angle (trim down direction). The two relays have normally open contacts, and the normally open contacts of the two relays are connected in series with an armature coil excited when the power trim motor is rotated in the trim up direction and an armature coil excited when the power trim motor is rotated in the trim down direction, respectively.

In the conventional control device, the trim up relay or the trim down relay is excited according to a deviation between a trim angle and a target value, and thus the power trim motor is rotated in the trim up direction or the trim down direction to cause the trim angle to reach a target value suitable for efficiently obtaining a propulsion force.

The target value of the trim angle minutely changes during navigation according to a pitch angle of a boat body or a boat speed. Thus, in the case where the control device disclosed in Japanese Patent Application Laid-Open Publication No. 61-105296 performs control to cause the trim angle of the outboard engine to reach the target value, the PTT device frequently repeatedly increases and decreases the trim angle, and the frequency of turning on/off a driving current of the power trim motor is significantly increased as compared with the case where a PTT device is operated according to a trim up command and a trim down command issued by an operator manually operating a trim command switch to adjust a trim angle.

Since the PTT device operates a heavy outboard engine, a high driving current flows through the power trim motor. A switch of a circuit for switching a rotational direction of the power trim motor frequently turns on/off the high driving current of the power trim motor. Thus, if a relay is used as the switch, a contact thereof significantly wears down to inevitably reduce durability of the control device.

As disclosed in Japanese Patent Application Laid-Open Publication No. 61-1.05296, when the power trim motor is controlled by turning on/off the switch, fine adjustment of the trim angle cannot be easily performed, and an overshoot and an undershoot occur when the trim angle approaches the target value, thereby preventing the trim angle from reaching the target value for a short time period. If it takes time for the trim angle to reach the target value, it takes time to stabilize a navigation state, and power consumption in the PTT device is also increased to increase a load on a power supply such as a battery, which is unpreferable.

The conventional control device for a power trim unit for an outboard engine does not include means for protecting overcurrent when overcurrent flows through a drive circuit of the power trim motor due to an increase in load on the power trim motor or the like. Thus, when overcurrent flows, components of the drive circuit or the power trim motor may fail.

The control device for a power trim unit for an outboard engine is placed in the same position as a controller for controlling an engine in many cases, and thus if the control device for a power trim unit fails, the controller of the engine may be also affected. If the controller of the engine is affected, the boat cannot navigate and cannot return to the port.

SUMMARY OF THE INVENTION

An object of the present invention is to provide a control device for a power trim unit for an outboard engine that can perform automatic control of a trim angle without reducing durability.

Another object of the present invention is to provide a control device for a power trim unit for an outboard engine that can cause a trim angle to reach a target value for a short time period without causing an overshoot and an undershoot.

Further object of the present invention is to provide a control device for a power trim unit for an outboard engine that can prevent components of a control device or a power trim motor from failing when overcurrent flows due to abnormality in the power trim motor or the like.

The present invention is directed to a control device for a power trim unit for an outboard engine for controlling a power trim unit for an outboard engine that uses a power trim motor as a drive source to change a trim angle of the outboard engine.

In the present invention, the control device includes: an H bridge circuit in which an upper side and a lower side of a bridge are comprised of upper semiconductor switches and lower semiconductor switches that are turned on when receiving drive signals, a DC voltage from a DC power supply is applied between a common connection point of the upper semiconductor switches and a common connection point of the lower semiconductor switches, and a connection point between each upper semiconductor switch and each lower semiconductor switch is connected to an input terminal of the power trim motor; an ignition switch that is turned on when the outboard engine is operated; a trim angle sensor that detects a trim angle of the outboard engine; trim angle automatic control means for performing control to cause the trim angle of the outboard engine to reach a target value by controlling provision of the drive signals to the semiconductor switches of the H bridge circuit so as to perform PWM control of a driving current supplied from the DC power supply through the H bridge circuit to the power trim motor according to a deviation between the target value of the trim angle set according to an operation state and a trim angle detected by the trim angle sensor; and overcurrent protection means for interrupting overcurrent when the overcurrent flows from the DC power supply through the H bridge circuit.

As described above, the H bridge circuit comprised of the semiconductor switches is used to switch a rotational direction of the power trim motor, and thus there is no wearing contact, thereby increasing durability of the control device.

Also as described above, the control to cause the trim angle to reach the target value is performed by performing the PWM control of the driving current supplied from the DC power supply through the H bridge circuit to the power trim motor according to the deviation between the target value of the trim angle and the trim angle detected by the trim angle sensor, thereby allowing fine adjustment of the trim angle. This prevents an overshoot and an undershoot from occurring when the trim angle approaches the target value, allows the trim angle to reach the target value for a short time period, and reduces power consumption in a PTT device to reduce a load on a power supply (generally, a battery).

Further, in the present invention, the overcurrent protection means for interrupting the overcurrent when the overcurrent flows from the DC power supply through the H bridge circuit is provided, thereby preventing components of the drive circuit or the power trim motor from failing due to the overcurrent.

In a preferred aspect of the present invention, the overcurrent protection means is comprised of a high side switch that is inserted between the common connection point of the upper semiconductor switches of the H bridge circuit and the DC power supply, and receives a drive signal and is turned on when the power trim motor is driven. The high side switch is a switch having a diagnosis function of monitoring a current flowing therethrough and providing overcurrent information to a microprocessor when the current under monitoring becomes excessive, and a protection function of entering an interruption state and interrupting overcurrent when the current under monitoring becomes excessive. The high side switch is known, and a commercially available one may be used.

As described above, the high side switch having the diagnosis function and the protection function is used as the overcurrent protection means, thereby eliminating the need for a current detection circuit and also the need for control means for turning off a switch element when overcurrent flows, and thus simplifying a construction of the control device. Also, the overcurrent information can be obtained from the high side switch, thereby facilitating display of abnormality, or facilitating stopping the provision of the drive signals to the switch elements of the H bridge circuit to prevent driving of the PTT device.

Generally, a battery that comprises a power supply is provided so that a negative output terminal thereof is connected to an outboard engine body (an outboard engine main body and an engine block). Thus, in the case where overcurrent protection means is inserted downstream of an H bridge circuit (between a common connection point of lower semiconductor switches and a DC power supply), a current passage that does not pass through the overcurrent protection means is formed when a short circuit is formed between wiring to a power trim motor and the outboard engine body, and a short-circuit current cannot be interrupted. On the other hand, as described above, the overcurrent protection means is provided upstream (on the high side) of the H bridge circuit, thereby preventing a state where a short-circuit current cannot be interrupted when a short circuit is formed between the power trim motor and the outboard engine body, and increasing safety.

In another preferred aspect of the present invention, a high side switch that is turned on when receiving a drive signal is used as each upper semiconductor switch of the H bridge circuit. The high side switch is a switch having a diagnosis function of monitoring a current flowing therethrough and providing overcurrent information to a microprocessor when the current under monitoring becomes excessive, and a protection function of entering an interruption state and interrupting the overcurrent when the current under monitoring becomes excessive.

Also when comprised as described above, the state where a short-circuit current cannot be interrupted when a short circuit is formed between the power trim motor and the outboard engine body can be prevented. When thus comprised, the upper semiconductor switch itself of the H bridge circuit has an overcurrent protection function, thereby reducing the number of power elements to simplify a circuit construction and reduce a size of a heat sink, and also reducing a component occupying area on a substrate to reduce a size of the control device. Also, the number of components is reduced to reduce the number of assembling steps to reduce production costs.

Further, as described above, when the high side switch is used as each upper semiconductor switch of the H bridge circuit, overcurrent flowing in forward rotation of the power trim motor can be distinguished from overcurrent flowing in reverse rotation thereof for detection. Thus, when a load on the power trim motor becomes excessive due to abnormality in a mechanism that changes the trim angle and overcurrent flows, it can be determined whether the abnormality occurs while the power trim motor is rotating in the trim up direction or the trim down direction, thereby allowing estimation of an abnormal spot.

In a further preferred aspect of the present invention, the control device further includes: a trim command switch that is manually operated to issue a trim up command and a trim down command; and manual operation time motor drive means for providing a drive signal to a predetermined semiconductor switch of the H bridge circuit so as to rotationally drive the power trim motor in a direction of trimming up the outboard engine and a direction of trimming down the outboard engine when the trim up command and the trim down command, respectively, are given.

The trim command switch and the manual operation time motor drive means are thus provided, thereby allowing manual adjustment of the trim angle in addition to the automatic control of the trim angle.

In a further preferred aspect of the present invention, a microprocessor is provided that is activated when the ignition switch (key switch) is turned on and when the trim command switch is operated, and information on the trim angle detected by the trim angle sensor is provided to the microprocessor, and the trim angle automatic control means and the manual operation time motor drive means are comprised by using the microprocessor.

As described above, the microprocessor is activated also when the trim command switch is operated, and the trim angle automatic control means and the manual operation time motor drive means are comprised by using the microprocessor. Thus, the microprocessor can be activated to trim up and trim down the outboard engine without turning on the ignition switch using a key, thereby facilitating maintenance.

The overcurrent protection means used in the present invention may have a function of interrupting overcurrent when the overcurrent flows from the DC power supply through the H bridge circuit, and is not limited to the one using the high side switch.

For example, the overcurrent protection means may be comprised of a current sensor that detects a current flowing through an H bridge circuit, and means for performing control to forcedly turn off an upper semiconductor switch of the H bridge circuit when the current sensor detects overcurrent.

BRIEF DESCRIPTION OF THE DRAWINGS

The above and other objects and features of the invention will be apparent from the detailed description of the preferred embodiments of the invention, which is described and illustrated with reference to the accompanying drawings, in which.

DETAILED DESCRIPTION OF THE PREFERRED EMBODIMENTS

Figure 1:
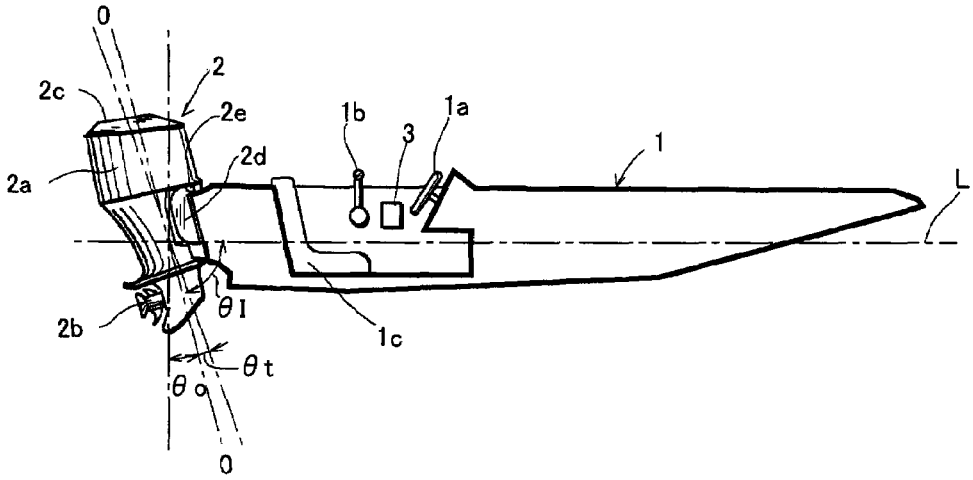
FIG. 1 is a schematic side view, partially in section, of an exemplary construction of a boat including an outboard engine.

Now, embodiments of the present invention will be described with reference to the drawings. FIG. 1 schematically shows an exemplary construction of a boat including an outboard engine. In FIG. 1, a reference numeral 1 denotes a boat body including a steering wheel 1*a*, a throttle lever 1*b*, a driver seat 1*c*, or the like, and 2 denotes an outboard engine.

The outboard engine 2 includes an outboard engine main body 2*c* including an engine 2*a* and a propeller 2*b* driven by the engine 2*a*, and brackets 2*d* provided on the left and right in a front part of the outboard engine main body, and is mounted to a transom (stern) of the boat body 1 via the brackets 2*d*. Between the left and right brackets 2*d*, a power trim unit is provided that uses a motor or a fluid pressure cylinder as a drive source and pivots the outboard engine main body 2*c* around pivots 2*e* provided in the brackets 2*d*.

Figure 2:
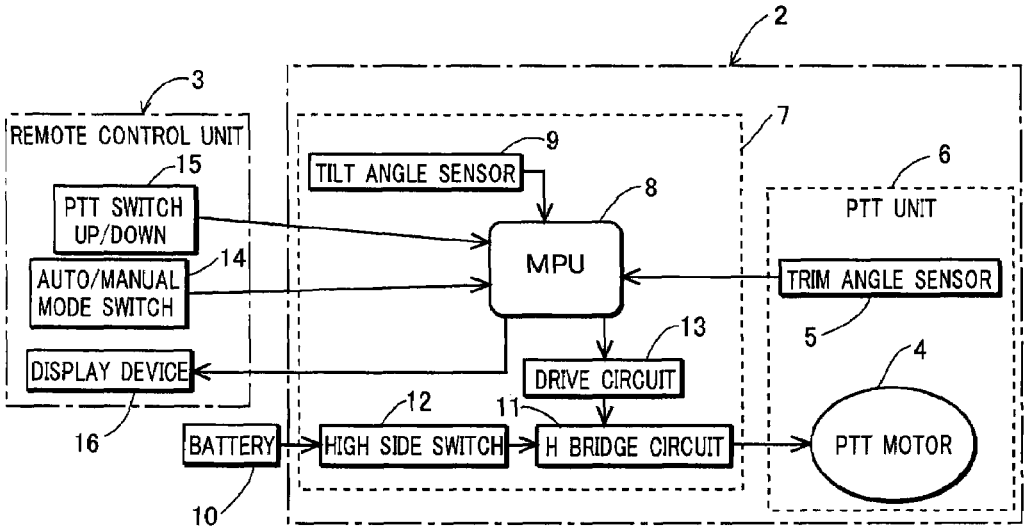
FIG. 2 is a block diagram of an entire construction of a control device according to an embodiment of the present invention.

FIG. 2 is a block diagram of an exemplary construction of a control device according to the present invention. In FIG. 2, a reference numeral 2 denotes the outboard engine, and 3 denotes a remote control unit mounted to a position in the boat body remote from the outboard engine (near a driver seat).

The outboard engine 2 includes a power trim unit (PTT unit) 6 including a trim mechanism that uses a power trim motor 4 as a power source and adjust a tilt angle of the outboard engine main body with respect to the boat body and a trim angle sensor 5 that detects the tilt angle of the outboard engine main body with respect to the boat body, and a controller (PTT controller) 7 that controls the power trim unit 6. As described above, the power trim unit 6 is provided between the left and right brackets 2*d* that mount the outboard engine to the stern of the boat body, and the PTT controller 7 is provided in a cover of the outboard engine 2.

The PTT controller 7 includes a microprocessor 8, a tilt angle sensor 9, an H bridge circuit 11 that switches a polarity of a driving current supplied from a battery 10 to the power trim motor 4, a high side switch 12 inserted between the battery 10 and the H bridge circuit 11, and a drive circuit 13 that provides drive signals to semiconductor switch elements of the H bridge circuit 11 according to a command given from the microprocessor 8.

The remote control unit 3 includes a mode switch 14 operated by an operator for selecting an operation mode between an automatic control mode and a manual mode, a trim command switch 15 operated by the operator for operating the outboard engine in a trim up direction and a trim down direction when the manual mode is selected, and a display device 16 that displays the present trim angle, the operation mode, and presence or absence of abnormality.

The trim angle sensor 5 is a sensor that detects a trim angle $\theta t$ of the outboard engine, and the tilt angle sensor 9 is a sensor that detects a tilt angle $\theta o$ of the outboard engine with respect to a vertical direction. Herein, among planes including a central axis of the propeller 2*b* of the outboard engine 2, one plane along the vertical direction when the boat body 1 is floating and resting on static water surface is a reference plane, and a direction along a waterline of the boat body 1 on the reference plane (a direction along a straight line L in FIG. 1) is a longitudinal direction of the boat. One straight line along the outboard engine 2 at a certain mounting angle $\theta I$ with respect to the longitudinal direction of the boat on the reference plane when the outboard engine is in a set minimum trim position (when the trim angle is zero) is a reference axis O-O of the outboard engine, and an angle formed by the reference axis of the outboard engine with respect to the vertical direction on the reference plane is a tilt angle $\theta o$ of the outboard engine. An angle obtained by subtracting the mounting angle $\theta I$ from the angle formed by the reference axis of the outboard engine with respect to the longitudinal direction of the boat on the reference plane is a trim angle $\theta t$ of the outboard engine.

The power trim motor 4 is an electric motor that comprises a drive source of the power trim unit. When the trim mechanism that adjusts the trim angle of the outboard engine is a hydraulic mechanism, a hydraulic pump that supplies pressure oil to the hydraulic mechanism is driven by the power trim motor 4. In some cases, the trim mechanism is comprised so as to adjust the trim angle of the outboard engine by transmitting rotation of the power trim motor 4 to the outboard engine via a reduction mechanism.

Figure 3:
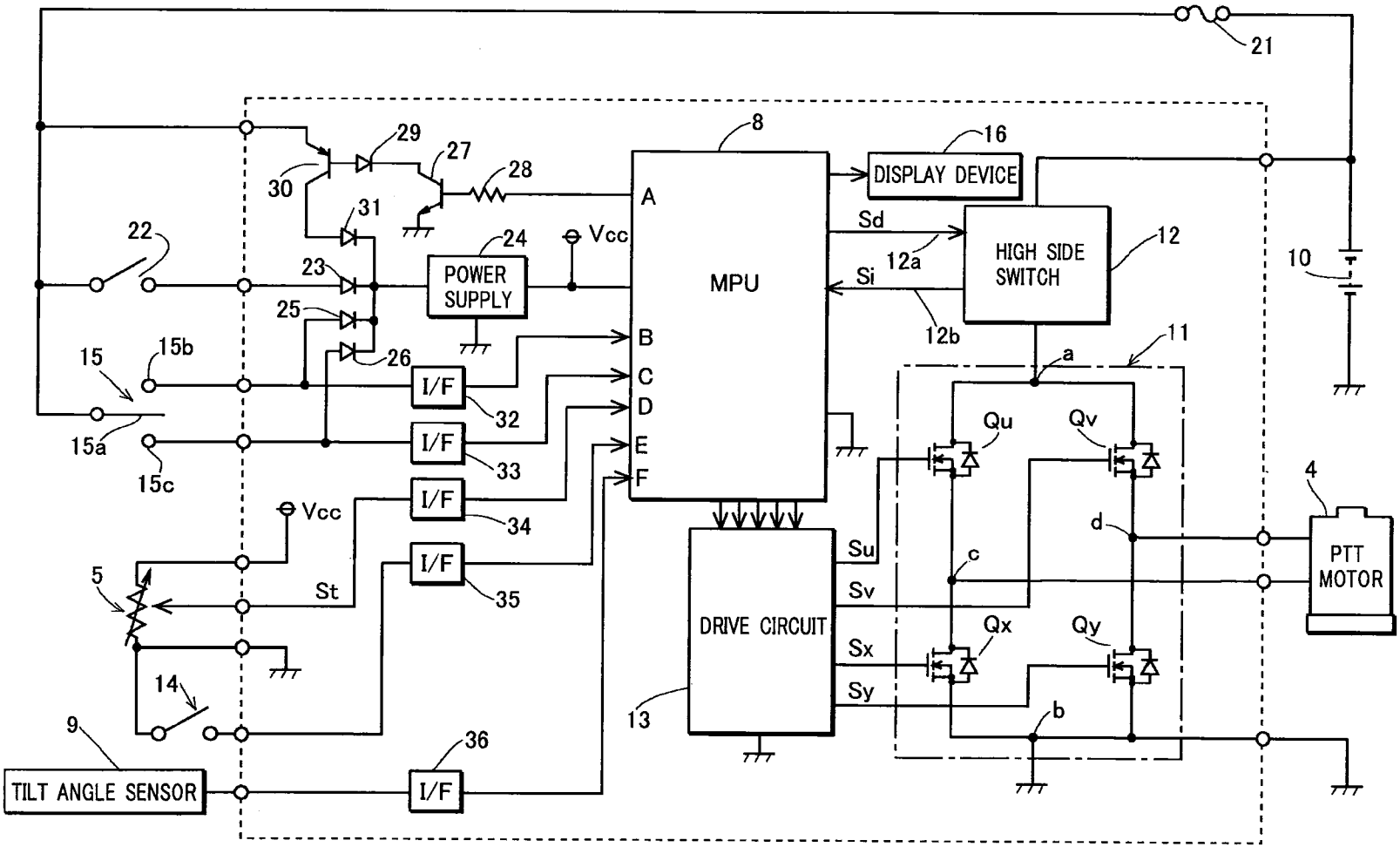
FIG. 3 is a schematic circuit diagram of an exemplary construction of hardware of the control device according to the embodiment of the present invention.

FIG. 3 shows an exemplary construction of a circuit of hardware of the control device for a power trim unit according to the present invention. In FIG. 3, the same components as in FIG. 2 are denoted by the same reference numerals. In the example in FIG. 3, the battery 10 is provided with a negative output terminal thereof grounded to the body of the outboard engine. An output voltage of the battery 10 is input to a power supply circuit 24 through a fuse 21, an ignition switch 22 that is turned on when the outboard engine is operated, and a diode 23 having an anode directed to the ignition switch. The power supply circuit 24 is comprised of a circuit that converts the output voltage of the battery 10 into a certain voltage suitable for driving the microprocessor 8, and an output voltage Vcc of the power supply circuit 24 is applied to a power supply terminal of the microprocessor 8. The microprocessor 8 is activated when receiving a power supply voltage and resets each part.

The trim command switch 15 is comprised of a changeover switch including a movable contact 15*a* connected to a positive output terminal of the battery 10 through the fuse 21, and stationary contacts 15*b* and 15*c* with which the movable contact 15*a* selectively comes into contact. The trim command switch 15 includes a trim up button and a trim down button, and is comprised so that the movable contact 15*a* comes into contact with the stationary contact 15*b* when the operator pushes the trim up button, and the movable contact 15*a* comes into contact with the stationary contact 15*c* when the operator pushes the trim down button. The stationary contacts 15*b* and 15*c* of the trim command switch are connected to an input terminal of the power supply circuit 24 through diodes 25 and 26, respectively, having anodes directed to the stationary contacts 15*b* and 15*c*. Thus, also when the trim command switch is operated, a power supply voltage is supplied from the battery 10 through the power supply circuit 24 to the microprocessor 8.

When the microprocessor 8 performs some processing after activated, the microprocessor 8 issues a power supply holding command from a port A until the processing is finished in order to prevent power from being shut down during the processing. A base of an NPN transistor 27 having a grounded emitter is connected to the port A of the microprocessor 8 through a resistor 28, and a base of a PNP transistor 30 is connected to a collector of the transistor 27 through a diode 29. An emitter of the transistor 30 is connected to the positive output terminal of the battery 10 through the fuse 21, and a collector of the transistor 30 is connected to the input terminal of the power supply circuit 24 through the diode 31.

When the microprocessor issues the power supply holding command from the port A, the transistors 27 and 30 are turned on, and a voltage is supplied from the battery 10 through the transistor 30 and the diode 31 to the power supply circuit 24. In this state, even if the ignition switch 22 is turned off, the power supply voltage is kept supplied to the microprocessor 8. In this embodiment, a power supply holding circuit that holds the power supply of the microprocessor is comprised of the resistor 28, the transistors 27 and 30, and the diode 31.

The microprocessor 8 also has ports B to F to which command signals or detection signals are input. To the ports B and C, the trim up command and the trim down command issued when the movable contact 15*a* of the trim command switch 15 comes into contact with the stationary contacts 15*b* and 15*c*, respectively, are input through interface (I/F) circuits 32 and 33.

The trim angle sensor 5 is comprised of a potentiometer provided so that pivot displacement of the outboard engine 2 is transmitted to the pivot, and the output voltage Vcc of the power supply circuit 24 is applied across the potentiometer. The trim angle sensor 5 outputs a trim angle detection signal St having a voltage value proportional to the trim angle through a movable contactor of the potentiometer. The trim angle detection signal St is input to the port D of the microprocessor through an interface circuit 34.

When one end of the mode switch 14 is connected to a ground potential portion, and the mode switch 14 is closed, potential of the other end of the mode switch falls to ground potential, and thus an automatic mode switching command is issued. The automatic mode switching command is input to the port E of the microprocessor through an interface circuit 35.

The tilt angle sensor 9 is comprised of an acceleration sensor, and an output thereof is input to the port F of the microprocessor through an interface circuit 36. The acceleration sensor that comprises the tilt angle sensor is comprised of a two-axis acceleration sensor that detects, for example, acceleration Gy applied along the reference axis O-O of the outboard engine, and acceleration Gx applied perpendicularly to the reference axis on the reference plane. When such an acceleration sensor is used, the microprocessor arithmetically operates an angle between the acceleration Gy and acceleration of gravity from an arc tangent value $\tan^{-1}$ (Gx/Gy) of a ratio Gx/Gy between the accelerations Gx and Gy, and thus arithmetically operates a tilt angle θo of the outboard engine.

The H bridge circuit 11 is a known switch circuit in which an upper side of a bridge is comprised of upper semiconductor switches Qu and Qv that are turned on when receiving drive signals, and a lower side of the bridge is comprised of lower semiconductor switches Qx and Qy that are turned on when receiving drive signals. A DC voltage from the DC power supply (battery 10) is applied between a positive input terminal a drawn from a common connection point of the upper semiconductor switches Qu and Qv and a negative input terminal b drawn from a common connection point of the lower semiconductor switches Qx and Qy, and an output terminal c drawn from a connection point between the upper semiconductor switch Qu and the lower semiconductor switch Qx and an output terminal d drawn from a connection point between the upper semiconductor switch Qv and the lower semiconductor switch Qy are connected to the input terminal of the power trim motor 4.

In the embodiment, the upper semiconductor switches Qu and Qv and the lower semiconductor switches Qx and Qy are comprised of MOSFETs, drains of the MOSFETs that comprise the upper semiconductor switches Qu and Qv are connected to the input terminal a, and sources of the MOSFETs that comprise the lower semiconductor switches Qx and Qy are connected to the input terminal b. A source of the MOSFET that comprises the upper semiconductor switch Qu and a drain of the MOSFET that comprises the lower semiconductor switch Qx are connected to the output terminal c, and a source of the MOSFET that comprises the upper semiconductor switch Qv and a drain of the MOSFET that comprises the lower semiconductor switch Qy are connected to the output terminal d.

The microprocessor 8 provides drive signals Su, Sv, Sx and Sy to the semiconductor switches Qu, Qv, Qx and Qy of the H bridge circuit 11 through the drive circuit 13. Each semiconductor switch of the H bridge circuit is in an on-state while receiving the drive signal, and passes a driving current from the battery 10 through the power trim motor 4.

In the embodiment, the high side switch 12 is inserted between the common connection point (positive input terminal) a of the upper semiconductor switches Qu and Qv of the H bridge circuit 11 and the battery (DC power supply).

The high side switch 12 is a switch having a switch function of keeping an on-state while a drive signal Sd is provided to a control terminal 12*a*, and entering an off-state when the drive signal Sd is removed, a diagnosis function of monitoring a current flowing therethrough and outputting an overcurrent detection signal Si from a detection signal output terminal 12*b* when the current under monitoring becomes excessive, and a protection function of entering an interruption state and interrupting overcurrent when the current under monitoring becomes excessive. The high side switch may be commercially available one. In the embodiment, overcurrent protection means for interrupting the overcurrent when the overcurrent flows from the battery 10 through the H bridge circuit 11 is comprised of the high side switch.

The microprocessor 8 turns on a pair of switches on diagonal positions of the bridge of the H bridge circuit 11 when driving the power trim motor 4, and thus passes a driving current having a predetermined polarity from the battery 10 through the power trim motor 4. The microprocessor 8 also performs PWM modulation of a drive signal provided to at least one of the pair of switches that are turned on, thus interrupts at least one of the switches at a predetermined duty ratio, and performs PWM control of the driving current supplied to the power trim motor.

For example, the microprocessor 8 turns on the upper switch Qv and the lower switch Qx of the H bridge circuit 11 when rotating the power trim motor 4 in the trim up direction. The microprocessor 8 also turns on/off the lower switch Qx to perform the PWM control of the driving current so as to pass a high driving current through the power trim motor when a deviation between the trim angle and a target value is large, and reduce an average value of the driving current supplied to the power trim motor with decreasing deviation between the trim angle and the target value.

When rotating the power trim motor in the trim down direction, the microprocessor 8 turns on the upper switch Qu and the lower switch Qy of the H bridge circuit 11, and turn on/off one of the upper switch Qu and the lower switch Qy, for example, the lower switch Qy to perform the PWM control of the driving current.

The microprocessor 8 provides, to the drive circuit 13, a switch drive command for providing a drive signal to a switch that needs to be turned on for passing a driving current required for causing the trim angle to reach the target value through the power trim motor, and a PWM signal. The drive circuit 13 provides a drive signal to a switch commanded to be turned on by the switch drive command given from the microprocessor among the switches Qu, Qv, Qx and Qy of the H bridge circuit 11, and interrupts a drive signal provided to a switch (for example, a lower switch) that is turned on/off for performing the PWM control of the driving current according to the PWM signal.

Figure 4:
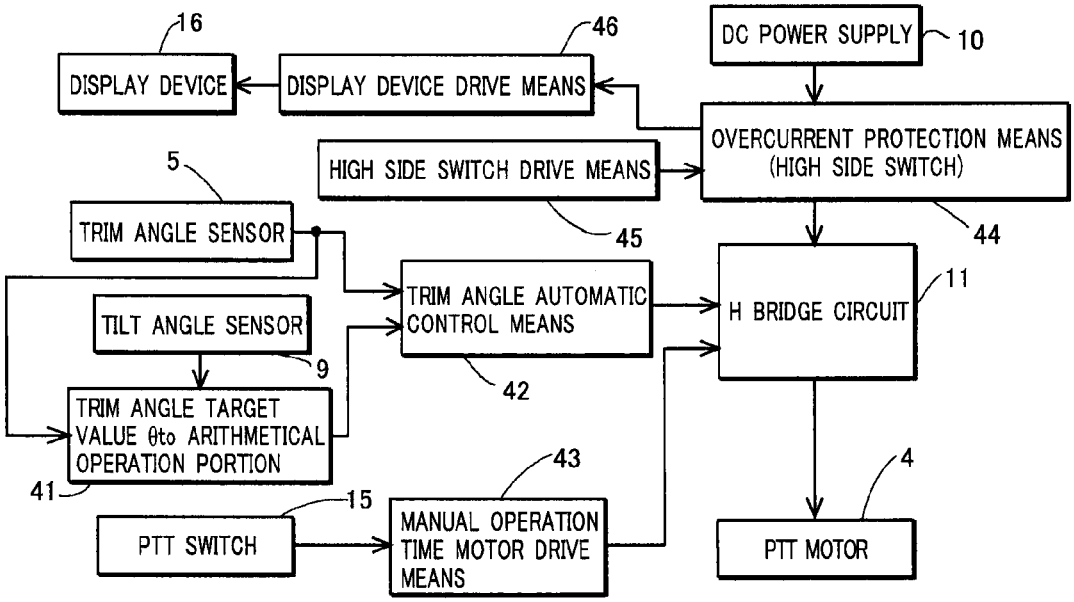
FIG. 4 is a block diagram of a construction including function achieving means comprised by a microprocessor of the control device according to the embodiment of the present invention.

The microprocessor 8 performs a predetermined program to comprise means for achieving various functions required for controlling the trim angle. FIG. 4 shows a construction of the control device including means comprised by the microprocessor 8. In FIG. 4, 41 denotes a trim angle target value arithmetical operation portion that arithmetically operates a target value θto of the trim angle based on the tilt angle θo of the outboard engine with respect to the vertical direction detected by the tilt angle sensor 9 and the present trim angle θt detected by the trim angle sensor 5, and 42 denotes trim angle automatic control means for performing control to cause the trim angle θt to reach the target value θto by controlling provision of the drive signals to the semiconductor switches of the H bridge circuit 11 so as to perform the PWM control of the driving current supplied from the battery 10 through the H bridge circuit 11 to the power trim motor 4 according to a deviation between the target value θto of the trim angle θt and the trim angle θt detected by the trim angle sensor 5. 43 denotes manual operation time motor drive means for providing a drive signal to a predetermined semiconductor switch of the H bridge circuit 11 so as to rotationally drive the power trim motor in a direction of trimming up the outboard engine and a direction of trimming down the outboard engine when the trim up command and the trim down command, respectively, are given from the trim command switch 15. 44 denotes overcurrent protection means for interrupting overcurrent when the overcurrent flows from the battery 10 through the H bridge circuit. In the embodiment, the overcurrent protection means 44 is comprised of the high side switch 12. Further, 45 denotes high side switch drive means for providing a drive signal to the high side switch 12 that comprises the overcurrent protection means 44 to turn on the high side switch 12 in activation of the microprocessor, and 46 denotes display device drive means for causing the display device 16 to display that abnormality occurs in the drive circuit of the power trim motor (that the overcurrent passes) when the high side switch 12 outputs an overcurrent detection signal Si.

The trim angle automatic control means 42 may have any construction according to a purpose of control. However, the trim angle automatic control means 42 in the embodiment performs target pitch angle following control to control the trim angle θt so that a pitch angle θp (an angle formed by the longitudinal direction of the boat body with respect to the horizontal surface on the reference plane) of the boat body 1 matches the target value. Thus, the trim angle target value arithmetical operation portion 41 first arithmetically operates the present pitch angle θp of the boat body from the mounting angle θI of the outboard engine 2 to the boat body 1, the trim angle θt of the outboard engine detected by the trim angle sensor 5, and the tilt angle θo detected by the tilt angle sensor 9, and arithmetically operates the target value θto of the trim angle required for the pitch angle θp to match a target value θpo according to a deviation between the pitch angle θp and the preset target value θpo of the pitch angle. The trim angle automatic control means 42 controls the switches of the H bridge circuit 11 and passes a current having a predetermined polarity through the power trim motor 4 so as to provide, to the power trim motor 4, a driving current required for rotating the power trim motor 4 in a direction of zeroing the deviation between the trim angle θt detected by the trim angle sensor 5 and the target value θto of the arithmetically operated trim angle.

The automatic control of the trim angle is not limited to the above described example. For example, a trim angle required for directing the axis of the propeller of the outboard engine in a direction that a propulsion force acts most efficiently is used as a target value of a trim angle (for example, a horizontal direction), and control is performed to cause a trim angle detected by a trim angle sensor to reach a target value. In this case, the trim angle target value arithmetical operation portion 41 arithmetically operates a trim angle required for directing the axis of the propeller of the outboard engine in a direction that a propulsion force acts most efficiently (for example, a horizontal direction) as a target value of the trim angle from the present trim angle and the tilt angle θo of the outboard engine. The trim angle automatic control means 42 performs control to cause the trim angle to reach the target value by controlling provision of drive signals to the semiconductor switches of the H bridge circuit 11 so as to perform PWM control of a driving current supplied from the battery 10 through the overcurrent protection means 44 and the H bridge circuit 11 to the power trim motor 4 according to a deviation between the target value of the trim angle and the trim angle detected by the trim angle sensor.

The manual operation time motor drive means 43 provides a drive signal to a predetermined semiconductor switch of the H bridge circuit 11 so as to rotate the power trim motor in the trim up direction and the trim down direction when a manual mode is selected and the trim command switch 15 issues a trim up command and a trim down command, respectively. The drive signal is also provided from the microprocessor 8 through the drive circuit 13.

Figure 6:
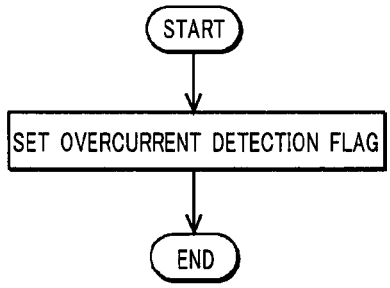
FIG. 6 is a flowchart of an algorithm of a processing performed by the microprocessor when overcurrent is detected in the embodiment of the present invention.
Figure 7:
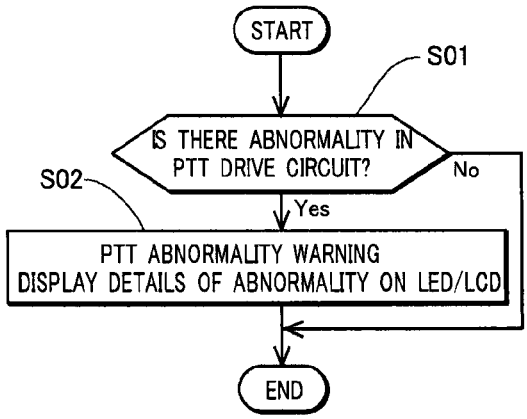
FIG. 7 is a flowchart of an algorithm of a processing performed by the microprocessor at regular time intervals in the embodiment of the present invention.
Figure 8:
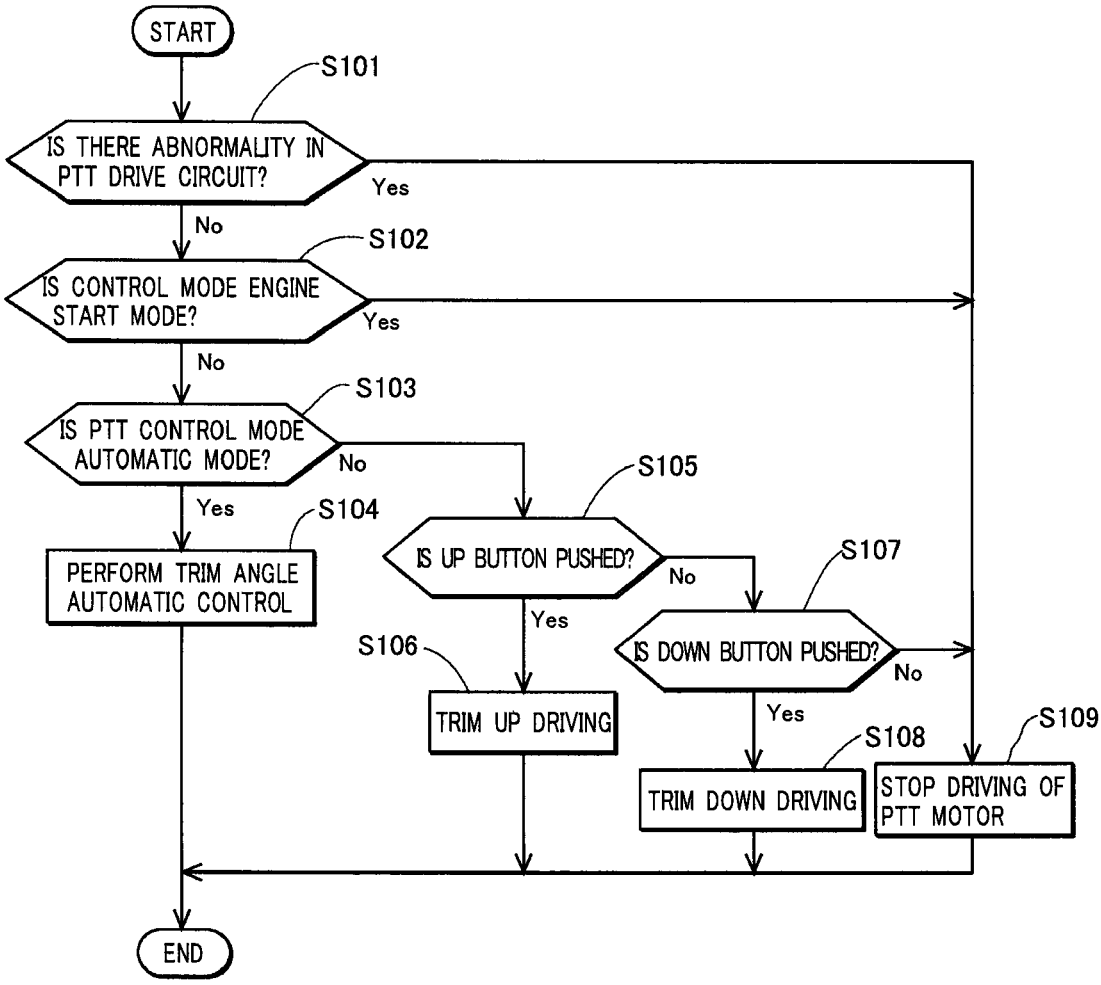
FIG. 8 is a flowchart of an algorithm of another processing performed by the microprocessor at regular time intervals in the embodiment of the present invention.

FIGS. 6 to 8 show flowcharts of algorithms performed by the microprocessor for comprising the control device in FIG. 4. The processing in FIG. 6 is performed when the high side switch 12 detects overcurrent, and in this processing, an overcurrent detection flag is set.

The processing in FIG. 7 is a PTT abnormality warning processing performed at regular time intervals. In this processing, in Step S01, it is determined whether there is abnormality in a PTT drive circuit. When it is determined that there is abnormality, an LED or an LCD provided in the display device 16 is caused to perform a PTT abnormality warning display operation. When it is determined in Step S01 that there is no abnormality in the drive circuit of the power trim motor, this processing is finished without performing any processing. The abnormal state of the PTT drive circuit includes, for example, a state where overcurrent flows through the H bridge circuit, a state where the trim angle sensor 5 is abnormal, or a state where a wire of the circuit is broken. In the embodiment, when the overcurrent detection flag is set by the processing in FIG. 6, it is determined from the state of the flag in Step S01 that abnormality that overcurrent flows through the PTT drive circuit occurs.

The processing in FIG. 8 is also performed at regular time intervals. When this processing is started, it is determined in Step S101 whether there is abnormality in the PTT drive circuit (in the embodiment, whether the overcurrent detection flag is set). When it is determined that there is abnormality, driving of the power trim motor is stopped in Step S109, and then this processing is finished. When it is determined in Step S101 that there is no abnormality in the PTT drive circuit, it is determined in Step S102 whether a control mode is an engine start mode. When it is determined that the control mode is the engine start mode, driving of the power trim motor is stopped in Step S109, and then this processing is finished.

When it is determined in Step S102 in the processing in FIG. 8 that the control mode is not the engine start mode, it is determined in Step S103 whether the control mode of the power trim motor is an automatic mode. When it is determined that the control mode is the automatic mode, the process proceeds to Step S104, the above described trim angle automatic control is performed, and then this processing is finished.

When it is determined in Step S103 that the control mode of the power trim motor is not the automatic mode, the process proceeds to Step S105, and it is determined whether the trim up button of the trim command switch 15 is pushed. When it is determined that the trim up button is pushed, the process proceeds to Step S106, drive signals are provided to the semiconductor switches Qv and Qx that need to be turned on for rotating the power trim motor 4 in the direction of trimming up the outboard engine (increasing the trim angle) to turn on the switches, thus the power trim motor is driven in the direction of trimming up the outboard engine, and this processing is finished.

When it is determined in Step S105 that the trim up button is not pushed, the process proceeds to Step S107, and it is determined whether the trim down button is pushed. When it is determined that the trim down button is pushed, the process proceeds to Step S108, and drive signals are provided to the semiconductor switches Qu and Qy that need to be turned on for rotating the power trim motor 4 in the direction of trimming down the outboard engine (decreasing the trim angle). Thus, the switches Qu and Qy are turned on, the power trim motor is driven in the direction of trimming down the outboard engine, and this processing is finished. When it is determined in Step S107 that the trim down button is not pushed, the power trim motor is stopped in Step S109, and then this processing is finished.

The display device drive means 46 is comprised by the processing in FIG. 7, and the trim angle automatic control means 42 is comprised by Step S104 in FIG. 8. The manual operation time motor drive means 43 is comprised by Steps S105 to S108 in FIG. 8.

Figure 5:
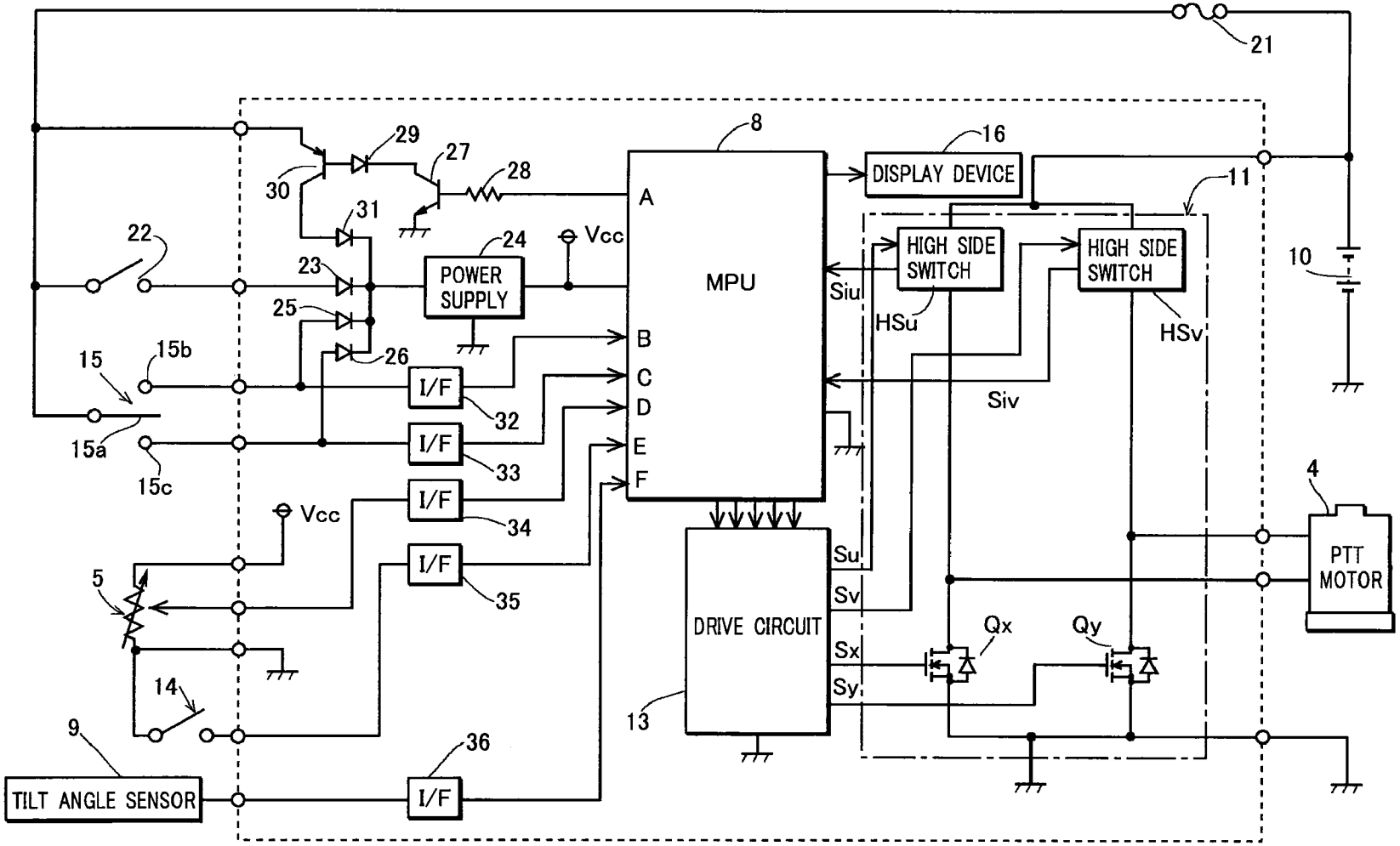
FIG. 5 is a schematic circuit diagram of an exemplary construction of hardware of a control device according to another embodiment of the present invention.

In the above described embodiment, the high side switch 12 that comprises the overcurrent protection means 44 is inserted between the common connection point a of the upper semiconductor switches of the H bridge circuit 11 and the positive output terminal of the battery 10. However, as shown in FIG. 5, it is allowed that high side switches HSu and HSv that are turned on when receiving drive signals are used as the upper semiconductor switches of the H bridge circuit 11 and connected to the drive circuit. In this case, drive signals Su and Sv are provided from the drive circuit 13 to the high side switches HSu and HSv, and the high side switches are controlled on/off like the switches Qu and Qv in FIG. 3. Also, overcurrent detection signals Siu and Siv output by the high side switches HSu and HSv are input to the microprocessor 8. In this example, the overcurrent protection means is comprised of the high side switches HSu and HSv. Other constructions of the control device in FIG. 5 are the same as in the example in FIG. 3.

As in the above described embodiments, the H bridge circuit 11 comprised of the semiconductor switches is used to switch the rotational direction of the power trim motor 4, and thus there is no wearing contact, thereby increasing durability of the control device.

As in the above described embodiments, the control to cause the trim angle to reach the target value is performed by performing the PWM control of the driving current supplied from the DC power supply through the H bridge circuit to the power trim motor according to the deviation between the target value of the trim angle and the trim angle detected by the trim angle sensor, thereby allowing fine adjustment of the trim angle. This prevents an overshoot and an undershoot from occurring when the trim angle approaches the target value, allows the trim angle to reach the target value for a short time period, and reduces power consumption in the PTT unit to reduce a load on the power supply (generally, the battery).

Further, as in the above described embodiments, the overcurrent protection means for interrupting the overcurrent when the overcurrent flows from the battery 10 through the H bridge circuit is provided, thereby preventing components of the H bridge circuit or a coil of the power trim motor from failing due to the overcurrent.

Further, as in the above described embodiments, the high side switch having the diagnosis function and the protection function is used as the overcurrent protection means, thereby eliminating the need for a current detection circuit and also the need for control means for turning off a switch element when overcurrent flows, and thus simplifying a construction of the control device. Also, the overcurrent information can be obtained from the high side switch, thereby facilitating display of abnormality, or facilitating stopping the provision of the drive signals to the switch elements of the H bridge circuit to prevent driving of the PTT device.

As described in the embodiments, generally, a battery 10 that comprises a power supply is provided so that a negative output terminal thereof is connected to an outboard engine body (an outboard engine main body and an engine block). Thus, in the case where overcurrent protection means is inserted downstream of an H bridge circuit 11 (between a common connection point of lower semiconductor switches and a DC power supply), a current passage that does not pass through the overcurrent protection means is formed when a short circuit is formed between wiring to a power trim motor 4 and the outboard engine body, and a short-circuit current cannot be interrupted. On the other hand, as in the above described embodiments, the overcurrent protection means is provided upstream (on the high side) of the H bridge circuit 11, thereby preventing a state where a short-circuit current cannot be interrupted when a short circuit is formed between the power trim motor 4 and the outboard engine body, and increasing safety.

As in the embodiment in FIG. 5, when the high side switch that is turned on when receiving the drive signal is used as each upper semiconductor switch of the H bridge circuit 11, the upper semiconductor switch itself of the H bridge circuit 11 has an overcurrent protection function, thereby reducing the number of power elements to simplify a circuit construction and reduce a size of a heat sink, and also reducing a component occupying area on a substrate to reduce a size of the control device. Also, the number of components is reduced to reduce the number of assembling steps to reduce production costs.

Further, as in the embodiment in FIG. 5, when the high side switch is used as each upper semiconductor switch of the H bridge circuit 11, overcurrent flowing in forward rotation of the power trim motor can be distinguished from overcurrent flowing in reverse rotation thereof for detection. Thus, when the load on the power trim motor becomes excessive due to abnormality in the mechanism that changes the trim angle and overcurrent flows, it can be determined whether the abnormality occurs while the power trim motor is rotating in the trim up direction or the trim down direction, thereby allowing estimation of an abnormal spot.

As in the above described embodiments, the microprocessor 8 is activated also when the trim command switch 15 is operated, and the trim angle automatic control means and the manual operation time motor drive means are comprised by using the microprocessor. Thus, the microprocessor can be activated to trim up and trim down the outboard engine without turning on the ignition switch using a key, thereby facilitating maintenance.

In the above described embodiments, the trim command switch that is manually operated to issue the trim up command and the trim down command, and the manual operation time motor drive means for providing the drive signal to the predetermined semiconductor switch of the H bridge circuit so as to rotationally drive the power trim motor in the direction of trimming up the outboard engine and the direction of trimming down the outboard engine when the trim up command and the trim down command, respectively, are given. However, these means may be omitted.

Although the preferred embodiments of the invention have been described and illustrated with reference to the accompanying drawings, it will be understood by those skilled in the art that there are by way of examples, and that various changes and modifications may be made without departing from the spirit and scope of the invention, which is defined only to the appended claims.

What is claimed is:

1. A control device for a power trim unit for an outboard engine for controlling a power trim unit for an outboard engine that uses a power trim motor as a drive source to change a trim angle of the outboard engine, comprising:

an H bridge circuit in which an upper side and a lower side of a bridge are comprised of upper semiconductor switches and lower semiconductor switches that are turned on when receiving drive signals, a DC voltage from a DC power supply is applied between a common connection point of said upper semiconductor switches and a common connection point of said lower semiconductor switches, and a connection point between each upper semiconductor switch and each lower semiconductor switch is connected to an input terminal of said power trim motor;

an ignition switch that is turned on when said outboard engine is operated;

a trim angle sensor that detects a trim angle of said outboard engine;

trim angle control means for performing control to cause said trim angle to reach a target value by controlling provision of the drive signals to the semiconductor switches of said H bridge circuit so as to perform PWM control of a driving current supplied from said DC power supply through said H bridge circuit to said power trim motor according to a deviation between the target value of said trim angle set according to an operation state and a trim angle detected by said trim angle sensor; and overcurrent protection means for interrupting overcurrent when the overcurrent flows from said DC power supply through said H bridge circuit.

2. The control device for a power trim unit for an outboard engine according to claim 1, wherein said overcurrent protection means is comprised of a high side switch that is inserted between the common connection point of the upper semiconductor switches of said H bridge circuit and said DC power supply, and receives a drive signal and is turned on when said power trim motor is driven, and said high side switch is a switch having a diagnosis function of monitoring a current flowing therethrough and providing overcurrent information to a microprocessor when the current under monitoring becomes excessive, and a protection function of entering an interruption state and interrupting overcurrent when the current under monitoring becomes excessive.

3. The control device for a power trim unit for an outboard engine according to claim 1, wherein a high side switch that is turned on when receiving a drive signal is used as each upper semiconductor switch of said H bridge circuit, and said high side switch is a switch having a diagnosis function of monitoring a current flowing therethrough and providing overcurrent information to a microprocessor when the current under monitoring becomes excessive, and a protection function of entering an interruption state and interrupting the overcurrent when the current under monitoring becomes excessive.

4. A control device for a power trim unit for an outboard engine for controlling a power trim unit for an outboard engine that uses a power trim motor as a drive source to change a trim angle of the outboard engine, comprising:

an H bridge circuit in which an upper side and a lower side of a bridge are comprised of upper semiconductor switches and lower semiconductor switches that are turned on when receiving drive signals, a DC voltage from a DC power supply is applied between a common connection point of said upper semiconductor switches and a common connection point of said lower semiconductor switches, and a connection point between each upper semiconductor switch and each lower semiconductor switch is connected to an input terminal of said power trim motor;

an ignition switch that is turned on when said outboard engine is operated;

a trim angle sensor that detects a trim angle of said outboard engine;

trim angle control means for performing control to cause said trim angle to reach a target value by controlling provision of the drive signals to the semiconductor switches of said H bridge circuit so as to perform PWM control of a driving current supplied from said DC power supply through said H bridge circuit to said power trim motor according to a deviation between the target value of said trim angle set according to an operation state and a trim angle detected by said trim angle sensor;

overcurrent protection means for interrupting overcurrent when the overcurrent flows from said DC power supply through said H bridge circuit;

a trim command switch that is manually operated to issue a trim up command and a trim down command; and manual operation time motor drive means for providing a drive signal to a predetermined semiconductor switch of said H bridge circuit so as to rotationally drive said power trim motor in a direction of trimming up said outboard engine and a direction of trimming down said outboard engine when said trim up command and said trim down command, respectively, are given.

5. The control device for a power trim unit for an outboard engine according to claim 4, wherein a microprocessor is provided that is activated when said ignition switch is turned on and when said trim command switch is operated, and information on the trim angle detected by said trim angle sensor is provided to said microprocessor, and said trim angle control means and said manual operation time motor drive means are comprised by using said microprocessor.

* * * * *

UNITED STATES PATENT AND TRADEMARK OFFICE

CERTIFICATE OF CORRECTION

PATENT NO. : 7,462,082 B2
APPLICATION NO. : 12/107200
DATED : December 9, 2008
INVENTOR(S) : Kishibata et al.

It is certified that error appears in the above-identified patent and that said Letters Patent is hereby corrected as shown below:

In column 2, line 12, please delete the "." after the numbers "61-1" and before the number "05296"

Signed and Sealed this

Twenty-second Day of June, 2010

David J. Kappos

David J. Kappos
*Director of the United States Patent and Trademark Office*